US009360831B2

(12) United States Patent
Matsuzaki et al.

(10) Patent No.: US 9,360,831 B2
(45) Date of Patent: Jun. 7, 2016

(54) DEVELOPING UNIT, PROCESS CARTRIDGE AND IMAGE FORMING APPARATUS

(71) Applicant: CANON KABUSHIKI KAISHA, Tokyo (JP)

(72) Inventors: Hiroomi Matsuzaki, Mishima (JP); Kojiro Yasui, Numazu (JP); Junichi Matsumura, Numazu (JP); Masatomi Yoshida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/973,248

(22) Filed: Aug. 22, 2013

(65) Prior Publication Data

US 2014/0064793 A1 Mar. 6, 2014

(30) Foreign Application Priority Data

Sep. 4, 2012 (JP) ..... 2012-193700

(51) Int. Cl.
*G03G 15/08* (2006.01)
*G03G 21/16* (2006.01)

(52) U.S. Cl.
CPC ..... *G03G 21/1676* (2013.01); *G03G 15/0841* (2013.01); *G03G 15/0868* (2013.01); *G03G 15/0874* (2013.01); *G03G 15/0882* (2013.01); *G03G 2215/0682* (2013.01); *G03G 2215/0687* (2013.01); *G03G 2215/0875* (2013.01)

(58) Field of Classification Search
CPC ..... G03G 15/0841; G03G 15/0868; G03G 15/0874; G03G 21/1676; G03G 2215/0682; G03G 2215/0687; G03G 2215/0875
USPC ..... 399/103, 106, 119, 120, 258
See application file for complete search history.

(56) References Cited

U.S. PATENT DOCUMENTS

| | | | | |
|---|---|---|---|---|
| 5,075,727 | A * | 12/1991 | Nakatomi | 399/103 |
| 5,264,901 | A * | 11/1993 | Rossiter | 399/106 |
| 5,594,535 | A * | 1/1997 | Beaufort et al. | 399/106 |
| 5,943,529 | A | 8/1999 | Miyabe et al. | |
| 5,966,567 | A | 10/1999 | Matsuzaki et al. | |
| 6,011,941 | A | 1/2000 | Takashima et al. | |
| 6,097,906 | A | 8/2000 | Matsuzaki et al. | |
| 6,128,462 | A | 10/2000 | Kato et al. | |

(Continued)

FOREIGN PATENT DOCUMENTS

JP 4-66980 A 3/1992

OTHER PUBLICATIONS

Office Action in Chinese Patent Application No. 201310385159.5, dated Nov. 4, 2015 (with English Translation).

*Primary Examiner* — Ryan Walsh
(74) *Attorney, Agent, or Firm* — Fitzpatrick, Cella, Harper & Scinto

(57) ABSTRACT

A developing unit includes: a frame; a flexible container, provided inside the frame, for accommodating a developer, wherein the flexible container includes an opening for permitting discharge of the developer; an urging member, provided inside the frame, for urging the flexible container to deform the flexible container; and a developer carrying member for carrying the developer discharged from the opening of the flexible container. The flexible container includes a projected portion projecting toward an outside of the flexible container. The projected portion is moved depending on deformation of the flexible container, by urging of the flexible container, to stir the developer discharged from the opening.

29 Claims, 13 Drawing Sheets

(56) References Cited

U.S. PATENT DOCUMENTS

| | | | | |
|---|---|---|---|---|
| 6,144,815 | A | 11/2000 | Chadani et al. | |
| 6,169,869 | B1 | 1/2001 | Inami et al. | |
| 6,173,140 | B1 | 1/2001 | Suzuki et al. | |
| 6,173,145 | B1 | 1/2001 | Chadani et al. | |
| 6,175,703 | B1 | 1/2001 | Nakazono et al. | |
| 6,205,305 | B1 | 3/2001 | Suzuki et al. | |
| 6,219,504 | B1 | 4/2001 | Matsuzaki et al. | |
| 6,282,389 | B1 | 8/2001 | Matsuzaki et al. | |
| 6,337,964 | B2 | 1/2002 | Inami et al. | |
| 6,405,004 | B2 | 6/2002 | Matsuzaki et al. | |
| 6,539,190 | B2 | 3/2003 | Oba et al. | |
| 6,549,736 | B2 | 4/2003 | Miyabe et al. | |
| 6,681,088 | B2 | 1/2004 | Kanno et al. | |
| 6,792,229 | B2 | 9/2004 | Matsuzaki | |
| 6,795,666 | B2 | 9/2004 | Miyabe et al. | |
| 6,859,629 | B2 | 2/2005 | Miura et al. | |
| 6,898,401 | B2 | 5/2005 | Okano et al. | |
| 6,931,226 | B2 | 8/2005 | Chadani et al. | |
| 6,934,485 | B2 | 8/2005 | Miyabe et al. | |
| 6,963,706 | B2 | 11/2005 | Morioka et al. | |
| 6,978,100 | B2 | 12/2005 | Yasui et al. | |
| 7,016,626 | B2 | 3/2006 | Yokomori et al. | |
| 7,068,965 | B2 | 6/2006 | Yoshino et al. | |
| 7,085,516 | B2 | 8/2006 | Kawai et al. | |
| 7,155,137 | B2 | 12/2006 | Yasui et al. | |
| 7,224,925 | B2 | 5/2007 | Sato et al. | |
| 7,349,657 | B2 | 3/2008 | Sato et al. | |
| 7,398,040 | B2 | 7/2008 | Yoshida | |
| 7,412,193 | B2 | 8/2008 | Sato et al. | |
| 8,385,787 | B2 * | 2/2013 | Yamaguchi et al. | 399/258 |
| 2011/0064478 | A1 * | 3/2011 | Yamaguchi et al. | 399/262 |
| 2013/0136489 | A1 | 5/2013 | Yamaguchi et al. | |
| 2013/0164039 | A1 | 6/2013 | Matsushita et al. | |

* cited by examiner (a)

(b)

(a)

(b)

DEVELOPING UNIT, PROCESS CARTRIDGE AND IMAGE FORMING APPARATUS

FIELD OF THE INVENTION AND RELATED ART

The present invention relates to an image forming apparatus such as a printer, and relates to a developing unit for use with the image forming apparatus, and a process cartridge.

The image forming apparatus forms an image n a recording material (medium) by using, e.g., an electrophotographic image forming process and, e.g., includes an electrophotographic copying machine, an electrophotographic printer (such as an LED printer or a laser beam printer), an electrophotographic facsimile apparatus. The cartridge is prepared by integrally constituting at least a developing means and a developing device accommodating a developer and is made detachably mountable to an image forming apparatus main assembly, or the cartridge is prepared by integrally constituting the developing device and a photosensitive member unit including at least a photosensitive member and is made detachably mountable to the image forming apparatus main assembly.

Further, a developer accommodating container and a developer accommodating unit are accommodated in the image forming apparatus or the cartridge, and include a flexible container for accommodating the developer.

In a conventional electrophotographic image forming apparatus, a process cartridge type in which an electrophotographic photosensitive member and a process means actable on the photosensitive member are integrally assembled into a cartridge and the cartridge is made detachably mountable to an electrophotographic image forming apparatus main assembly has been employed.

FIG. 14 is a perspective view showing a state of a developer accommodating portion of the process cartridge used in such a conventional image forming apparatus.

In such a process cartridge, as shown in FIG. 14, an opening (portion) provided to a developer accommodating frame 31 for accommodating the developer is sealed with a toner seal 32 as a sealing member. Further, during use, a bonding portion 33 of the toner seal 32 is peeled off to unseal the opening to permit supply of the developer. Such a type has been widely employed (Japanese Laid-Open Patent Application (JP-A) Hei 4-66980).

Further, a process cartridge using a deformable inside container as a countermeasure against such a problem that the developer is scattered in the process cartridge in a filling step of the developer during manufacturing of the process cartridge has been devised (JP-A Hei 4-66980).

For the purpose of reducing a cost of a developer supplying device by improving operativity of the supply of the developer and by preventing scattering of the developer in the process cartridge, a method of accommodating the developer in the deformable inside container has been described in JP-A Hei 4-66980.

On the other hand, in order to effectively supply the developer to a developing roller, in some case, there is a need to stir the developer between the opening of the developer accommodating portion and the developing roller. In such cases, there was a need to separately provide a stirring device.

SUMMARY OF THE INVENTION

An object of the present invention is to provide a developing unit, a process cartridge and an image forming apparatus which are capable of performing stirring in the neighborhood of a developer carrying member without providing a particular stirring device.

According to an aspect of the present invention, there is provided a developing unit comprising: a frame; a flexible container, provided inside the frame, for accommodating a developer, wherein the flexible container includes an opening for permitting discharge of the developer; an urging member, provided inside the frame, for urging the flexible container to deform the flexible container; and a developer carrying member for carrying the developer discharged from the opening of the flexible container, wherein the flexible container includes a projected portion projecting toward an outside of the flexible container, and wherein the projected portion is moved depending on deformation of the flexible container, by urging of the flexible container, to stir the developer discharged from the opening.

These and other objects, features and advantages of the present invention will become more apparent upon a consideration of the following description of the preferred embodiments of the present invention taken in conjunction with the accompanying drawings.

Figure 4:
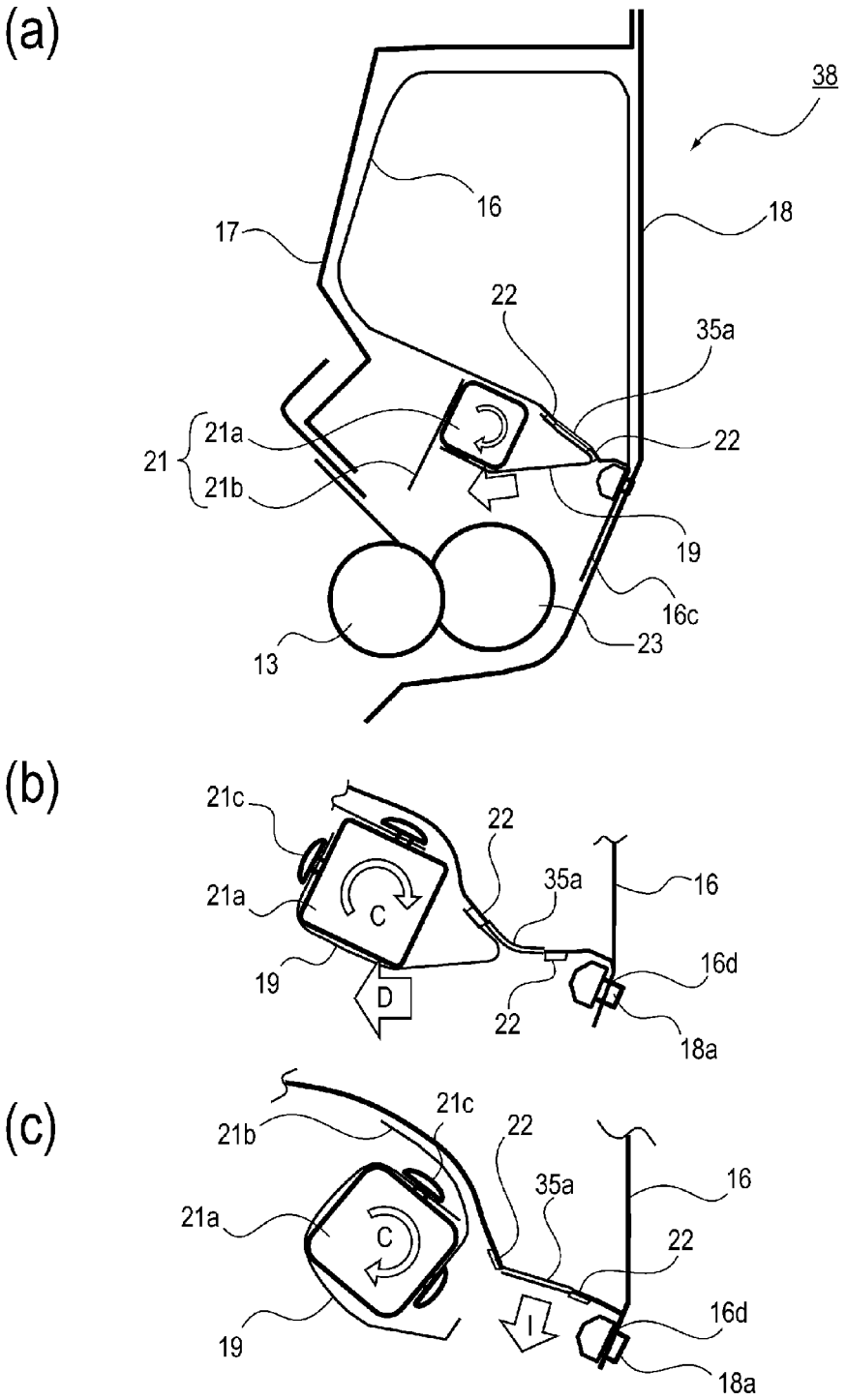

Parts (a), (b) and (c) of FIG. 4 are sectional views of a developing unit in Embodiment 1, wherein (a) is the sectional view of a whole developing unit showing a state before a sealing member is peeled off from an opening of the developing unit, (b) is an enlarged sectional view showing a state in which the sealing member is being peeled from the opening of the developing unit, and (c) is an enlarged sectional view showing a state in which the sealing member is completely peeled off from the opening of the developing unit.

Figure 5:
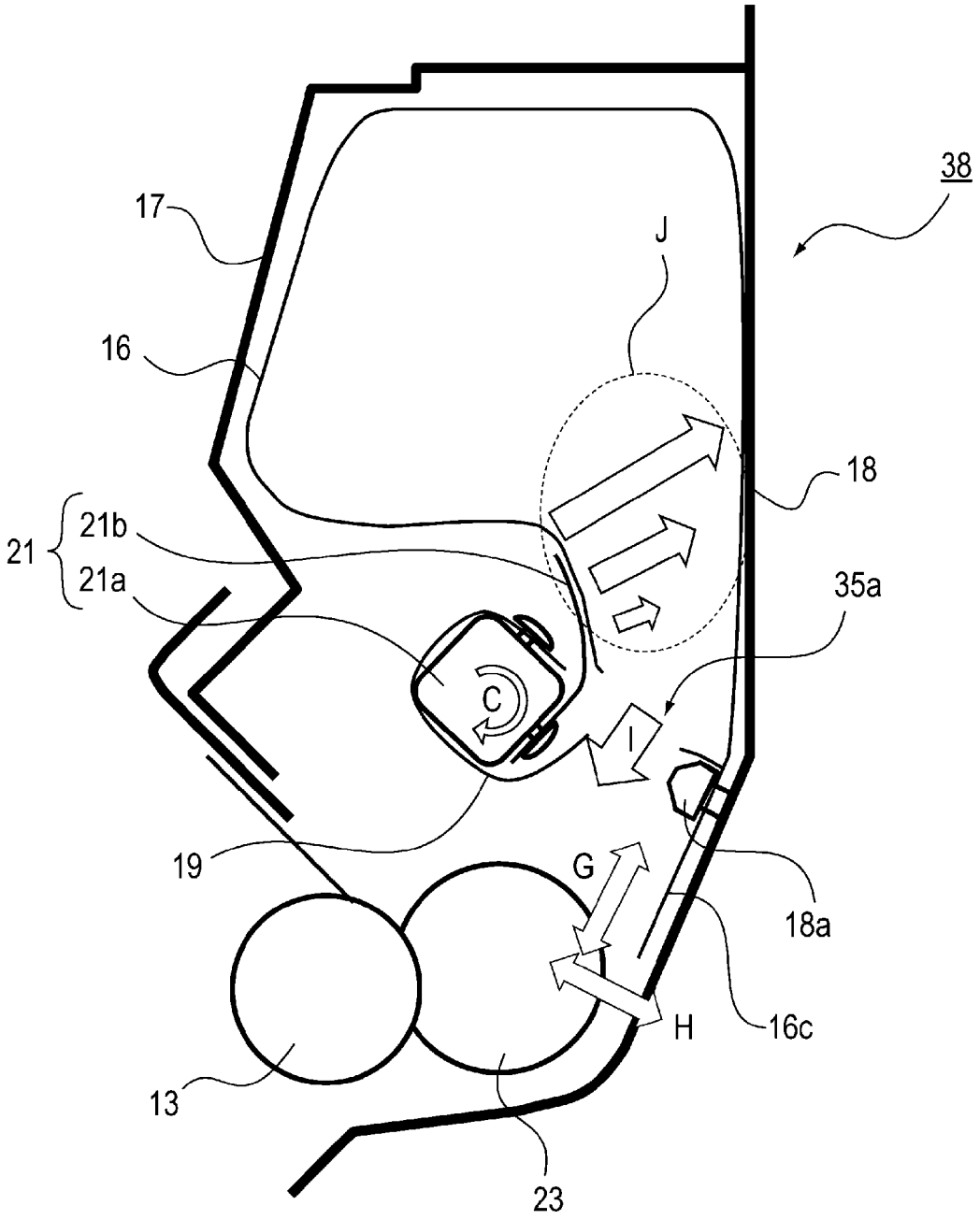

FIG. 5 is a sectional view showing a structure of the developing unit in Embodiment 1 and shows a state in which an urging member urges the developer bag.

Figure 6:
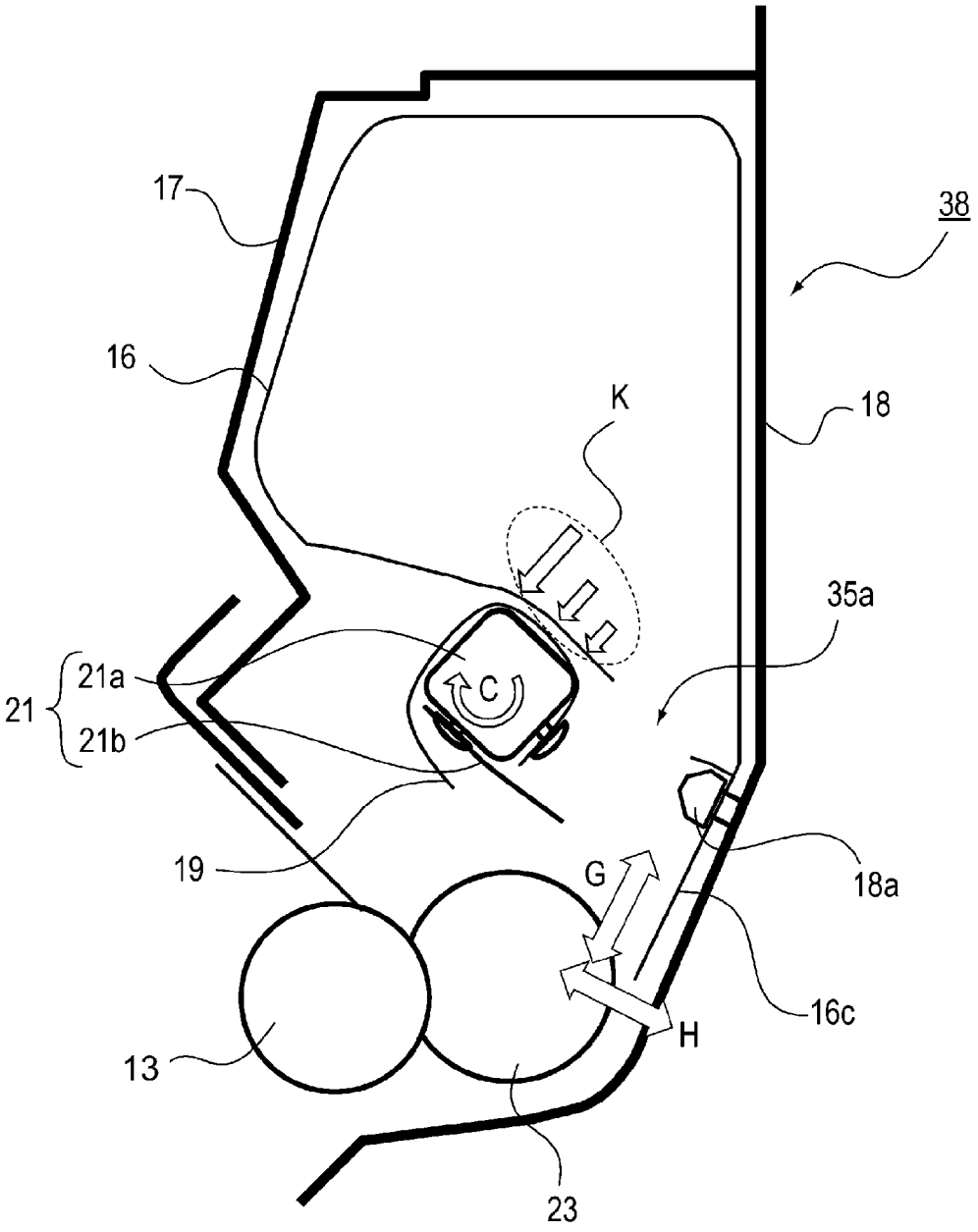

FIG. 6 is a sectional view showing a structure of the developing unit in Embodiment 1 and shows a state in which the urging member is separated from the developer bag.

Figure 7:
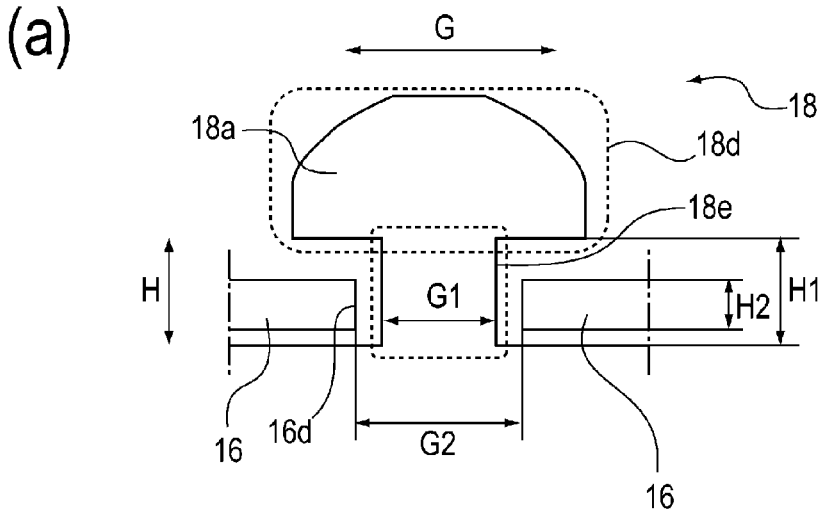
Figure 7:
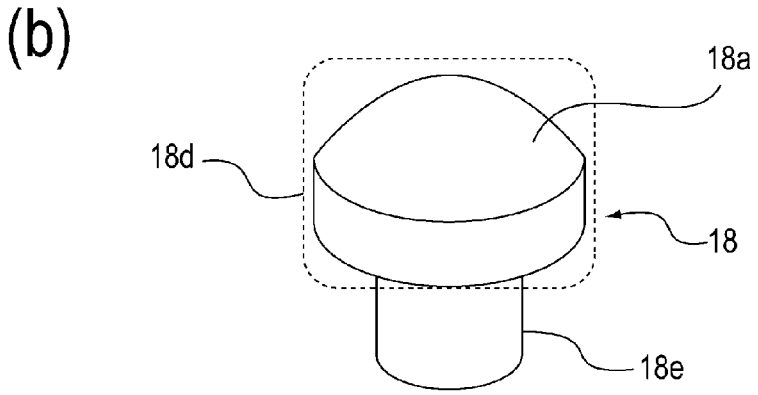

Parts (a) and (b) of FIG. 7 are sectional view and a perspective view, respectively, showing a locked portion and a locking portion in Embodiment 1, wherein (a) shows the locked portion and the locking portion, and (b) shows the locking portion.

Figure 8:
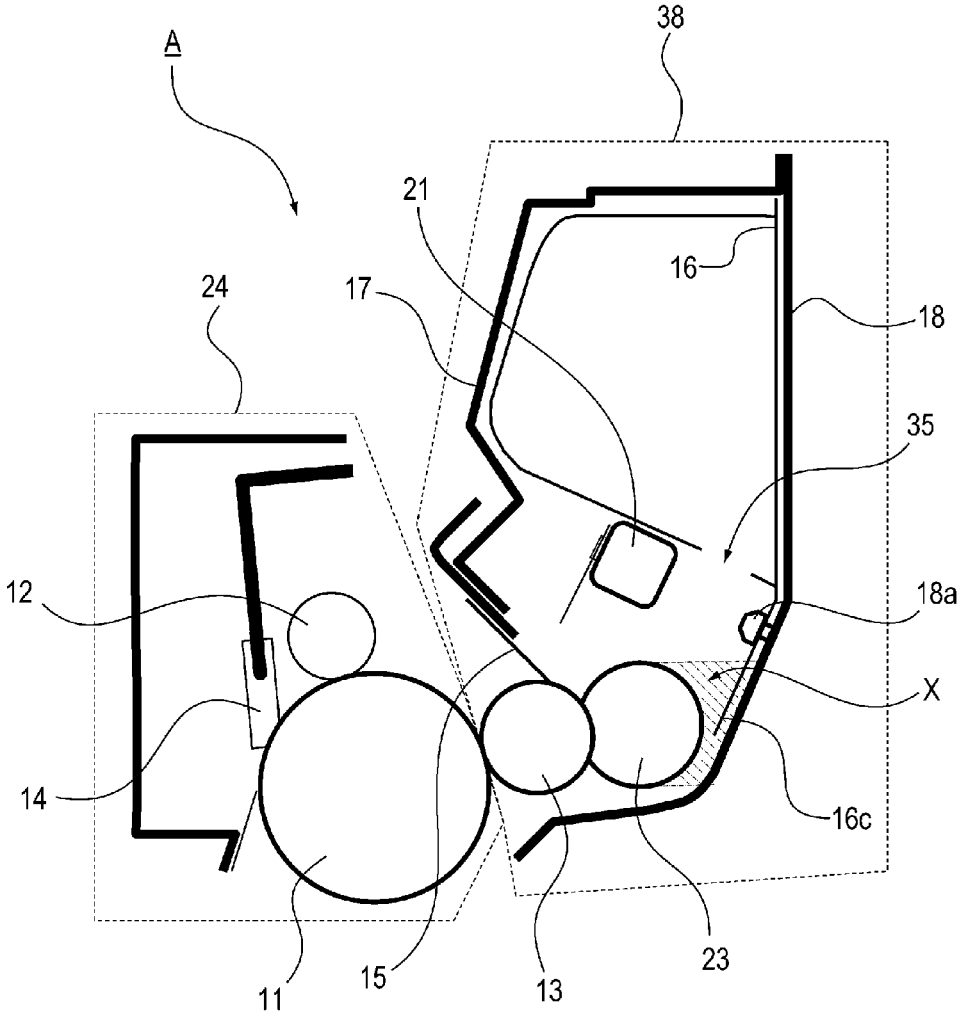

FIG. 8 is a sectional view of the process cartridge in Embodiment 1 and shows a region of a toner to be stirred.

Figure 9:
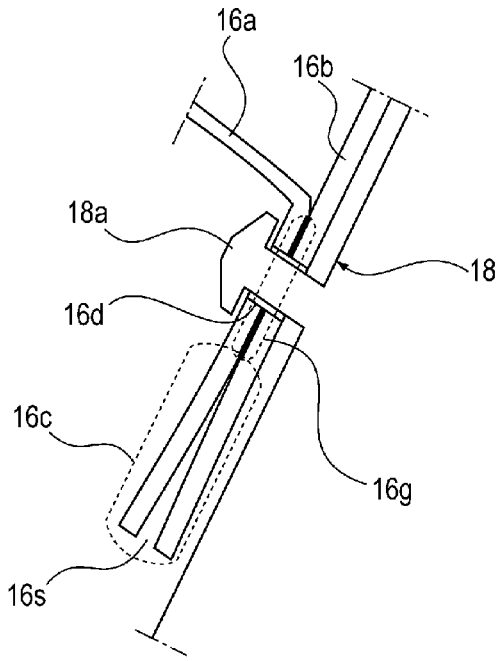
Figure 9:
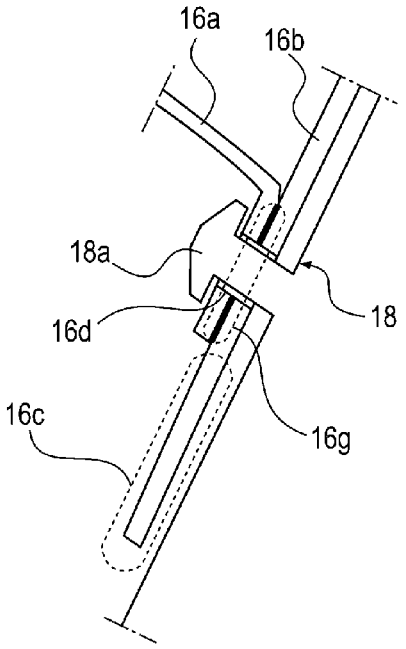

Parts (a) and (b) of FIG. 9 are sectional views each showing a structure of a projected portion in Embodiment 1.

Figure 10:
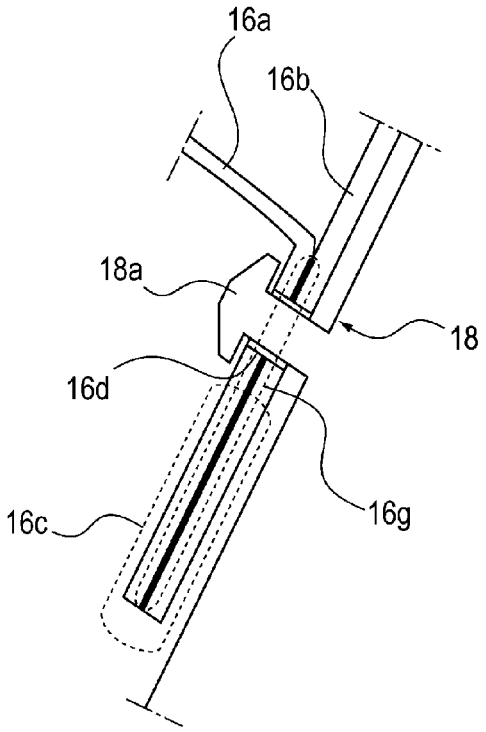
Figure 10:
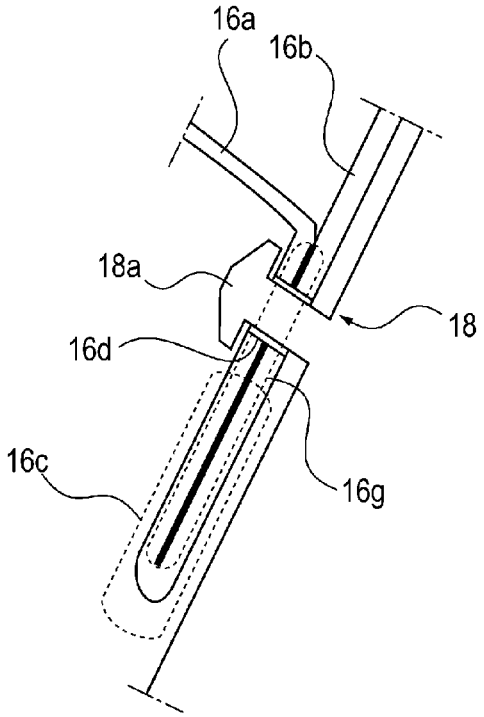

Parts (a) and (b) of FIG. 10 are sectional views each showing an example of a structure of a projected portion of the developer bag in Embodiment 1.

Figure 11:
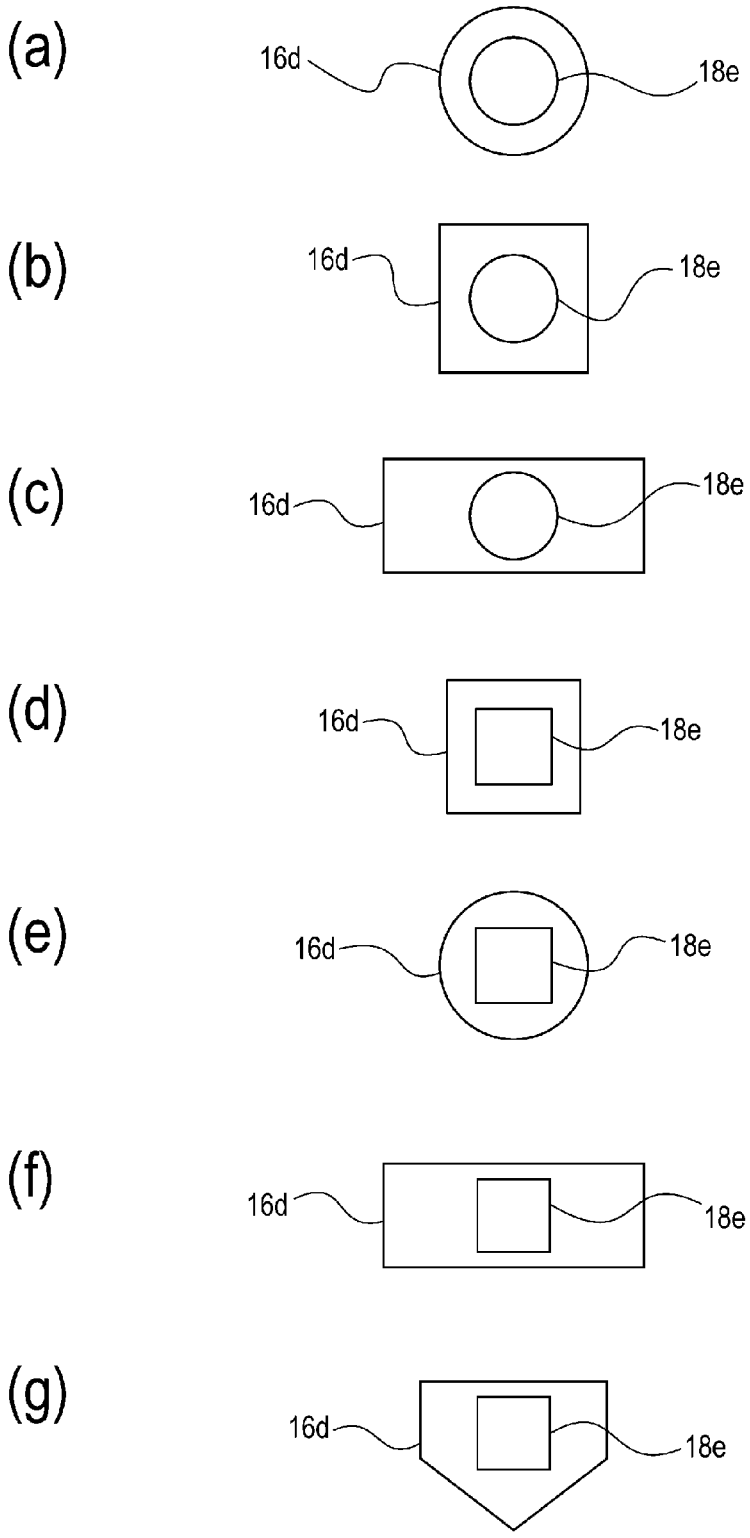

Parts (a) to (g) of FIG. 11 are sectional views each showing shapes of a locking portion and a locked portion in Embodiment 1, wherein (a) shows a hole shape of the locked portion and a columnar portion of an elongated cylindrical shape of the locking portion, and each of (b) to (g) shows a hole shape of the locked portion and another shape of an elongated columnar portion of the position of a frame.

Figure 12:
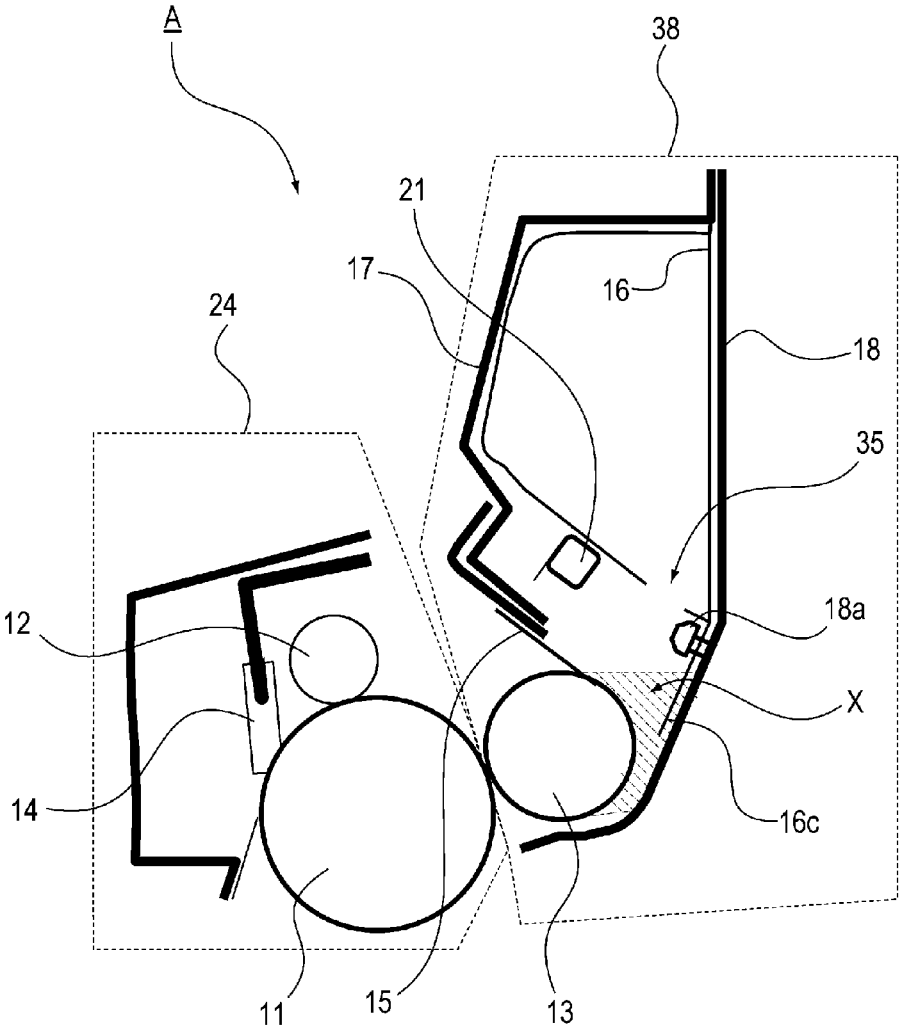

FIG. 12 is a sectional view showing a structure of a process cartridge in Embodiment 2 of the present invention.

Figure 13:
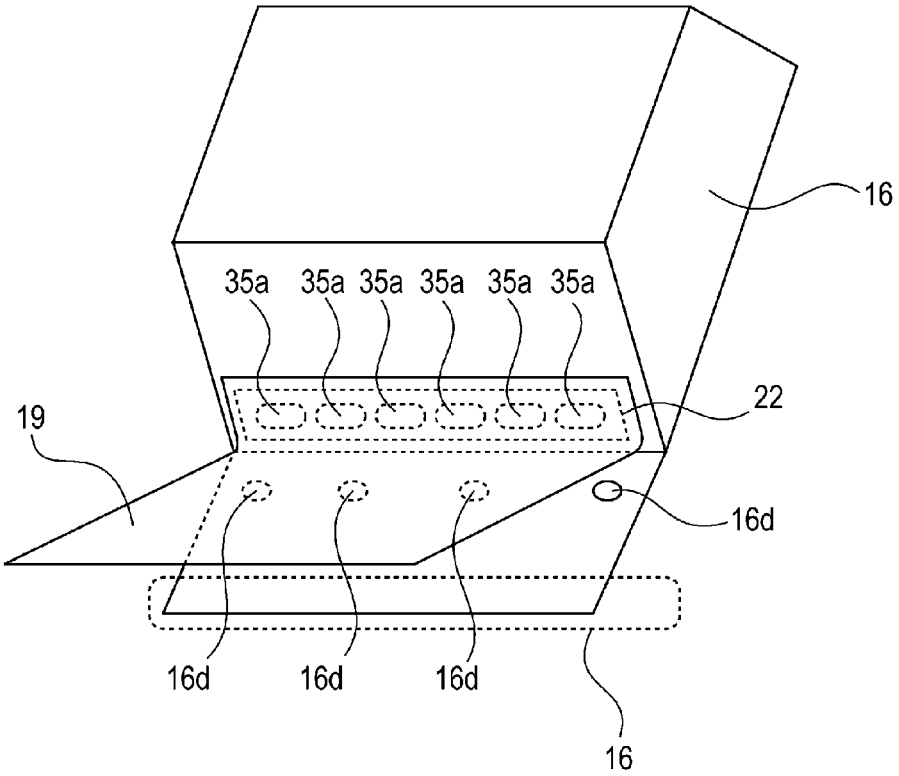

FIG. 13 is a perspective view showing a state in which the sealing member seals the opening of the developer bag in Embodiment 1.

Figure 14:
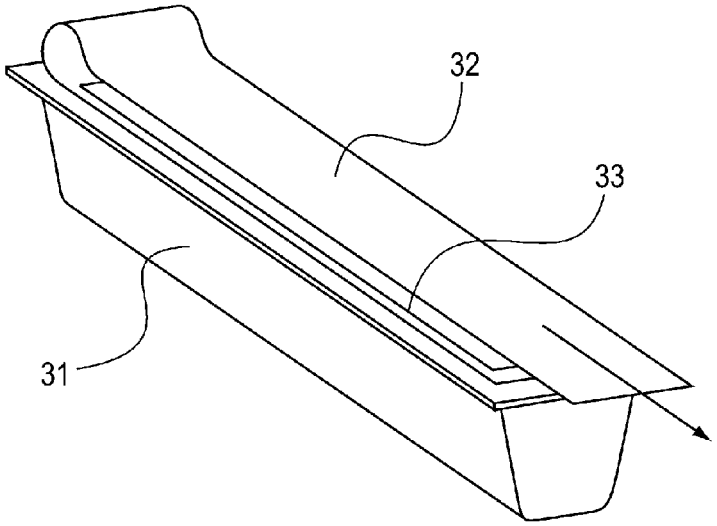

FIG. 14 is a perspective view showing a state of a developer accommodating portion of a process cartridge for use with a conventional image forming apparatus.

DESCRIPTION OF THE PREFERRED EMBODIMENTS

With reference to the drawings, embodiments of the present invention will be described specifically below.

<Embodiment 1>

(Structure of Image Forming Apparatus)

Figure 1:
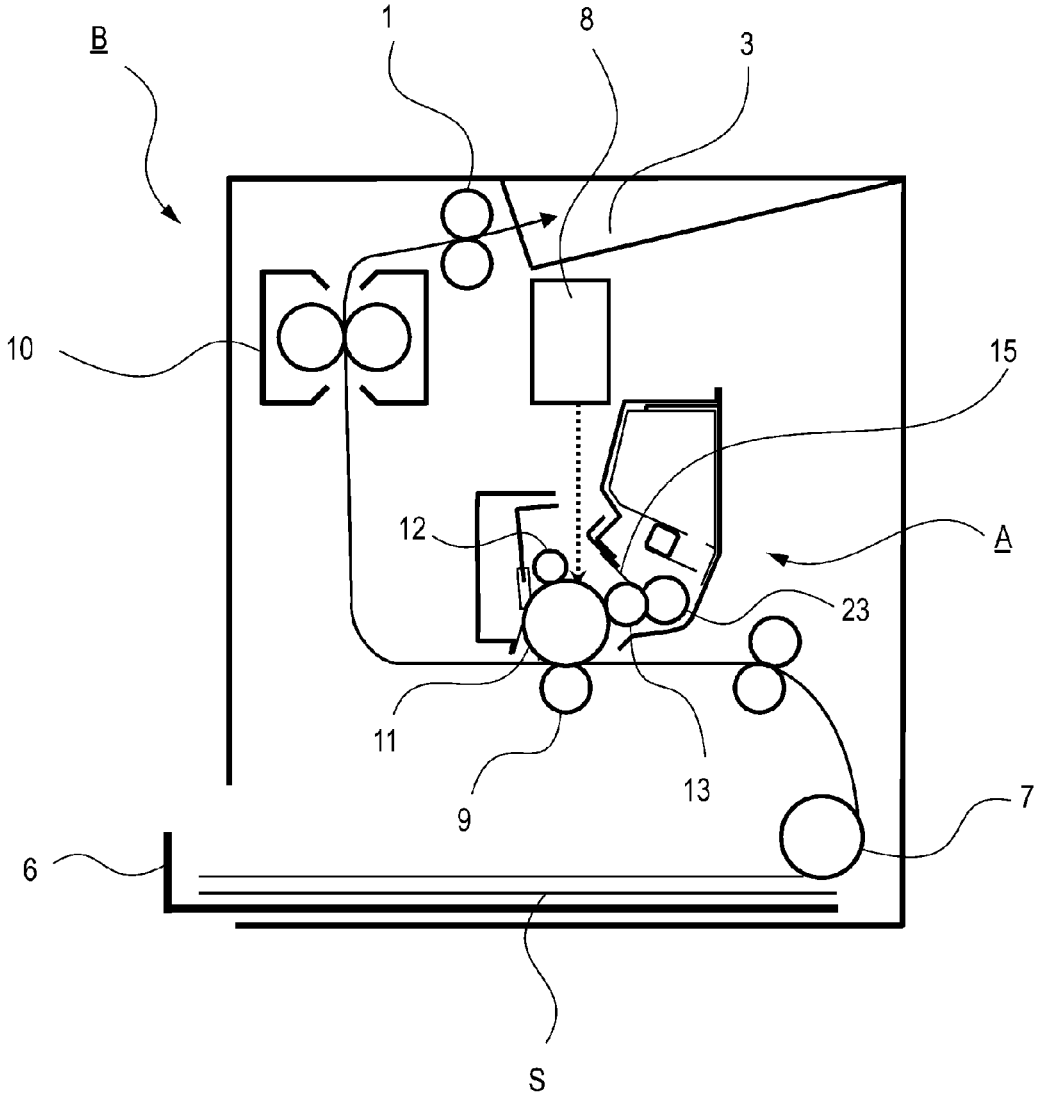
FIG. 1 is a sectional view showing a structure of an image forming apparatus in Embodiment 1 of the present invention.

FIG. 1 is a sectional view showing a structure of an image forming apparatus in this embodiment.

In image formation, a sheet S (image forming material or medium) is fed by a feeding roller 7 from a sheet cassette 6 mounted at a lower portion of an image forming apparatus main assembly B, and in synchronism with the sheet feeding, a latent image is formed on a photosensitive drum 11 by effecting selective light exposure from an exposure device 8. A developer is supplied to a developing roller 13 (developer carrying member) by a sponge-like developer supplying roller 23, and is carried in a thin layer on a surface of the developing roller 13 by a developing blade 15. By applying a developing bias to the developing roller 13, the developer is supplied depending on the latent image to develop the latent image into a desired developer image. This developer image is transferred onto the sheet S by bias voltage application to a transfer roller 9 (transfer means). The sheet S is conveyed to a fixing device 10 and is then subjected to image fixing, and thereafter is discharged onto a discharge portion 3 at an upper portion of the image forming apparatus main assembly by a discharging roller 1.

(Structure of Process Cartridge)

Figure 2:
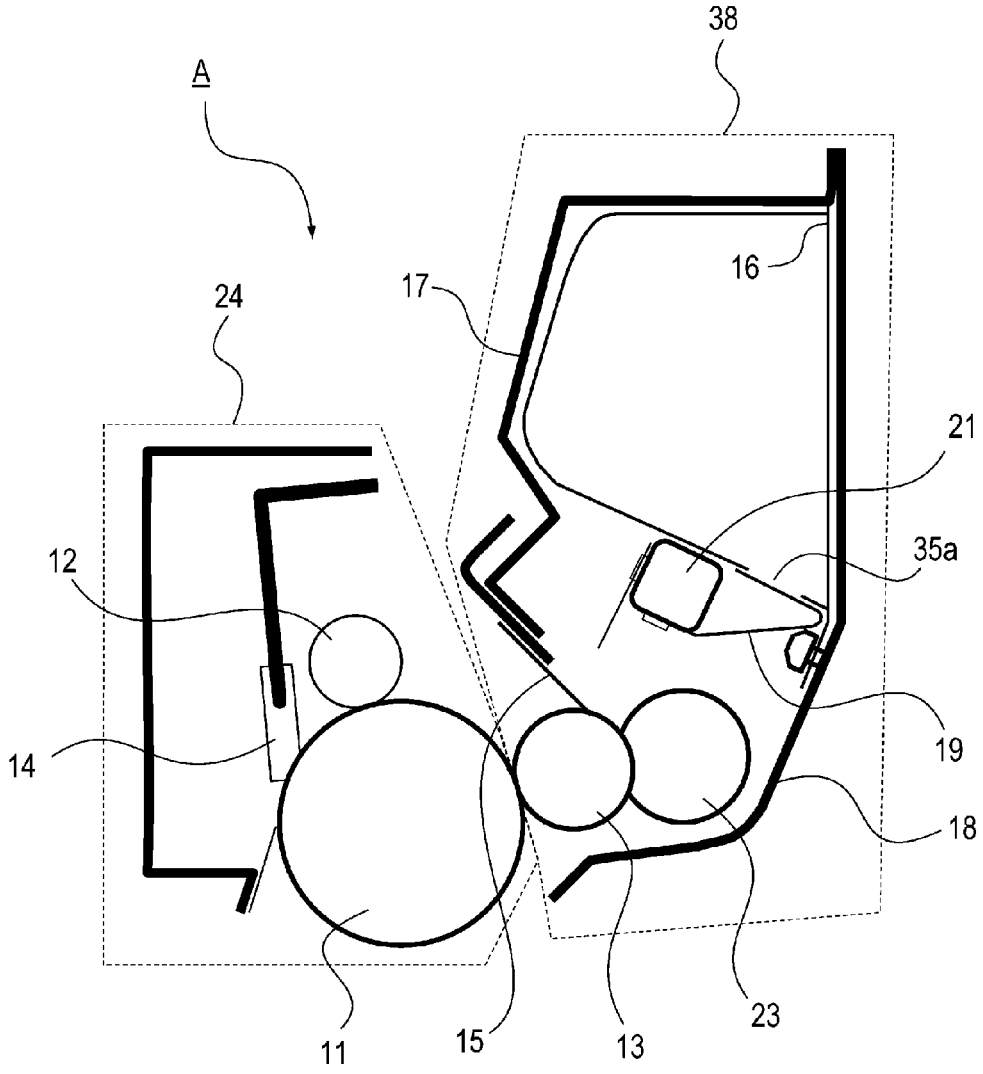
FIG. 2 is a sectional view showing a structure of a process cartridge to be mounted in the image forming apparatus shown in FIG. 1.

FIG. 2 is a sectional view showing a structure of a process cartridge A to be mounted in the image forming apparatus main assembly B.

As shown in FIG. 2, the process cartridge A integrally includes a cleaning unit 24 and a developing unit 38, and is constituted so as to be detachably mountable to the image forming apparatus main assembly 1 shown in FIG. 1.

The cleaning unit 24 includes the photosensitive drum 1 as an image bearing member, and includes a charging roller 12 and an elastic cleaning blade 14 which are provided at a periphery of the photosensitive drum 11.

The developing unit 38 includes a frame 17 and a frame 18. At an inside portion surrounded by the frame 17 and the frame 18, the developing roller 13 as the developer carrying member, the developing blade 15, the developer supplying roller 23 and a flexible developer bag 16 (flexible container) accommodating the developer are provided. Incidentally, the developing roller 13 and the developing blade 15 are supported by the frame 17.

(Structure of Developer Bag)

Figure 3:
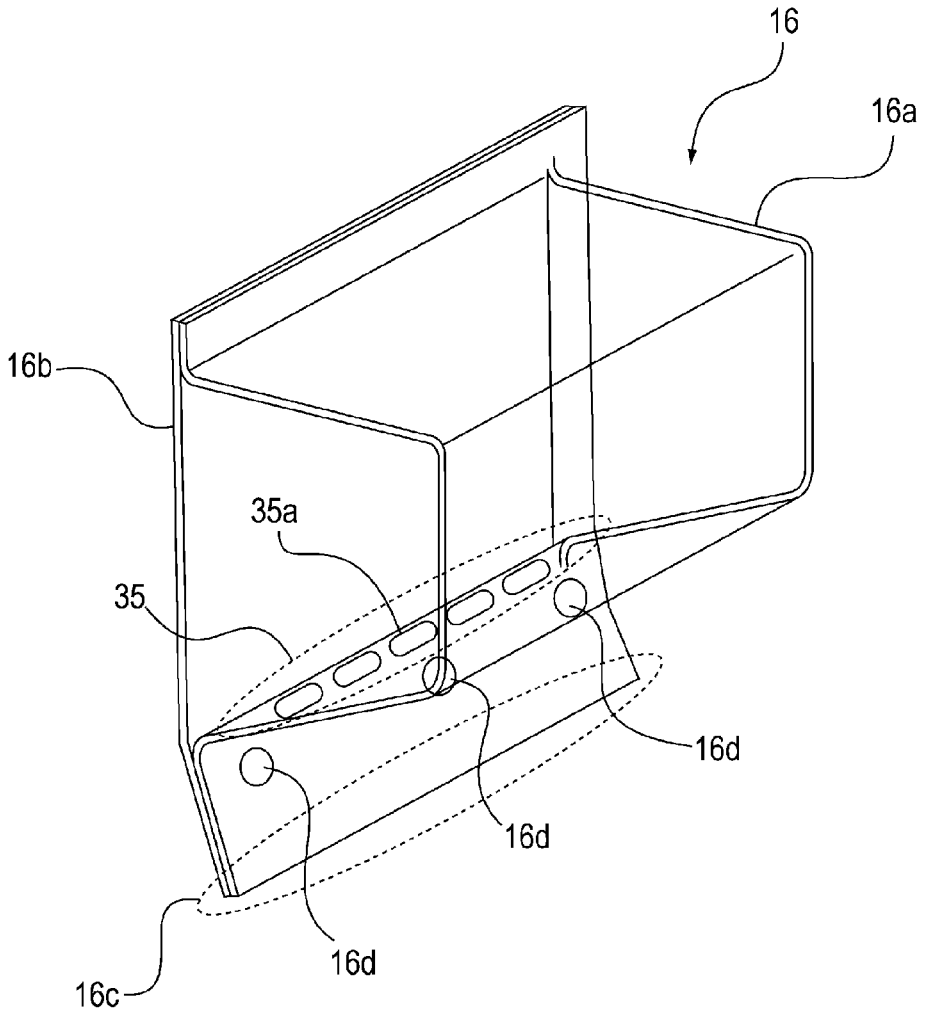
FIG. 3 is a perspective view showing a structure of a developer bag in Embodiment 1.

FIG. 3 is a perspective view showing a structure of the developer bag 16.

As shown in FIG. 3, the developer bag 16 accommodates the developer therein and has the flexibility and a deformable bag shape, and includes a plurality of openings 35*a* at a discharging portion 35 for permitting discharge of the accommodated developer.

The developer bag 16 is prepared by bonding an accommodating portion 16*a* (first flexible member) having a three-dimensional shape for accommodating the developer and a planar sheet portion 16*b* (second flexible member) to each other.

Each of the plurality of openings 35*a* has an elongated circular shape. The shape of the plurality of openings 35*a* may also be shapes, other than the elongated circular shape, such as a circular hole shape and a rectangular shape. The shape and size of the openings 35*a* are appropriately be selected from the viewpoints of an amount of discharge of the toner to be discharged from the developer bag 16, strength of the developer bag 16 in the neighborhood of the openings 35*a*, and the like.

Further, the openings 35*a* are disposed so as to open in a downward direction of the developer bag 16 so that the developer is supplied in a direction of gravitation during image formation.

Parts (a) to (c) of FIG. 4 are sectional views of the developing unit 38, wherein (a) shows a state of a whole developing unit 38 before a sealing member 19 is peeled off from the openings 35*a* of the developing unit 38, (b) is an enlarged sectional view showing a state in which the sealing member 19 is being peeled from the openings 35*a* of the developing unit 38, and (c) is an enlarged sectional view showing a state in which the sealing member 19 is completely peeled off from the openings 35*a* of the developing unit 38.

As shown in (a) of FIG. 4, before the developing unit 38 is first used, a periphery 22 of the openings 35*a* is sealed with the sealing member 19, and the toner is accommodated inside the developer bag 16.

FIG. 13 is a perspective view showing a state in which the openings 35*a* of the developer bag 16 are sealed with the sealing member 19. As shown in FIG. 13, the sealing member 19 seals the periphery 22 of the openings 35*a* at its end portion. Incidentally, the sealing member 19 is engaged with an urging member 21 at its another end portion by a fixing member 21*c*.

Further, the developer bag 16 includes a locked portion (portion-to-be-locked) 16*d* to be engaged with a locking portion 18*a* of the frame 18 (FIG. 3).

(Locking of Developer Bag)

A relationship of locking between the locked portion 16*d* of the developer bag 16 and the locking portion 18*a* of the frame 18 will be described. As shown in FIG. 3, the locked portion 16*d* of the developer bag 16 is a circular(-shaped) hole.

Parts (a) and (b) of FIG. 7 are schematic views showing the locked portion 16*d* and the locking portion 18*a*, wherein (a) is a sectional view of the locked portion 16*d* of the developer bag 16 and the locking portion 18*a* of the frame 18, and (b) is a perspective view of the locking portion 18*a* of the frame 18.

As shown in FIG. 7, the locking portion 18*a* of the frame 18 has a shape including a rounded top (head) portion 18*d* and an elongated (narrow) cylindrical columnar portion 18*e*. The developer bag 16 is locked to the frame 18 by engaging the locked portion 16*d* of the developer bag 16 with the cylindrical columnar portion 18*e* of the locking portion 18*a*. Incidentally, the reason why the top portion 18*d* has the rounded shape is that the developer bag 16 is pressed against the locking portion 18*a* of the frame 18 from above during assembling to permit easy mounting.

When a diameter of the cylindrical columnar portion 18*e* of the locking portion 18*a* of the frame 18 is G1 and a hole diameter of the locked portion 16*d* of the developer bag 16 is G2, a relationship of G1<G2 is satisfied. Further, when a height of the cylindrical columnar portion 18*e* (in the vertical direction of FIG. 7) is H1 and a thickness of the developer bag 16 at a periphery of the locked portion 16*d* of the developer bag 16 is H2, a relationship of H2<H1 is satisfied.

For this reason, with respect to a radial direction (G) of the hole of the locked portion 16*d* of the developer bag 16, there is a gap (spacing) corresponding to a difference between G2 and G1, and with respect to a height direction (H), there is a gap (spacing) corresponding to a difference between H2 and H1. For this reason, the developer bag 16 is movable in the radial direction of the hole by a distance of the gap between G1 and G2 and is movable in the height direction by a distance of the gap between H2 and H1.

(Structure of Projected Portion)

Next, a projected portion 16*c* projecting to the outside of the developer bag 16 will be described.

Parts (a) and (b) of FIG. 10 are sectional views each showing an example of a structure of the projected portion 16*c*. In the structural example shown in (a) of FIG. 10, an end portion of the accommodating portion 16*a* and an end portion of the sheet portion 16*b* are bonded to each other to constitute the projected portion 16*c*. In the structural example shown in (b) of FIG. 10, an end portion of the accommodating portion 16*a* is bonded to the sheet portion 16*b* and is folded back to constitute the projected portion 16*c*.

Incidentally, in this embodiment, the projected portion 16*c* is a bonding-together portion 16*g* formed by bonding the accommodating portion 16*a* and the sheet 16*b* together during manufacturing of the developer bag 16.

Further, an end portion of the projected portion 16*c* is disposed in a region (hatched portion X in FIG. 8) between the developer supplying roller 23 and the frame 18 in cross section in an attitude during image formation. That is, the end portion of the projected portion 16*c* is disposed so as to be located between an upper end and a lower end of the developer supplying roller 23 with respect to the vertical direction and between the developer supplying roller 23 and the frame 18 with respect to the horizontal direction. Further, the projected portion 16*c* is provided below the openings 35*a* with respect to the direction of gravitation.

Parts (a) and (b) of FIG. 9 are sectional views each showing an example of a structure of the projected portion 16*c*.

In the structural example shown in (a) of FIG. 9, the projected portion 16*c* is branched by the bonding-together portion 16*g* into two (a plurality of) portions without bonding the end portions of the accommodating portion 16*a* and the sheet portion 16*b* together to create a space 16*s* between the accommodating portion 16*a* and the sheet portion 16*b*. By employing such a constitution, it is possible to more effectively stir the developer in a manner in which the developer is stirred between the accommodating portion 16*a* and the sheet portion 16*b*. In the structural example shown in (b) of FIG. 9, an extended portion of the sheet portion 16*c* extended from the bonding-together portion 16*g* is the projected portion 16*c*. Incidentally, in (b) of FIG. 9, the structure in which the sheet portion 16*b* is extended is shown, but in place of the sheet portion 16*b*, the accommodating portion 16*a* may also be extended. That is, the projected portion 16*c* is constituted so as to include an edge (end) portion of at least one of the accommodating portion 16*a* and the sheet portion 16*b*.

As shown in FIGS. 9 and 10, the projected portion 16*c* is constituted by bonding of the plurality of members to each other or by folding back a member, so that the resultant projected portions 16*c* are different in strength and stirring performance. For that reason, the structure of the projected portion 16*c* may only be appropriately selected depending on a required stirring performance.

(Structure of Urging Member)

FIG. 5 is a sectional view showing a structure of the developing unit in a state in which the urging member 21 urges the developer bag 16.

As shown in FIG. 5, the urging member 21 includes a shaft portion 21*a* (rotatable member) and an urging sheet 21*b* fixed on the shaft portion 21*a*, and is rotatably provided in a space defined by the frames 17 and 18.

The urging member 21 is rotationally driven by a driving means of the image forming apparatus main assembly B to be rotated in a direction of an arrow C. The urging member 21 is fixed on a surface of the shaft portion 21*a* having a rectangular cross section, and is rotated together with the shaft portion 21*a*. Further, as shown in FIG. 4, the sealing member 19 is fixed to an end portion of the urging member 21, so that the urging member 21 also functions as a means for winding up the sealing member 19.

(Unsealing Operation of Urging Member)

An unsealing operation of the openings 35*a* of the developer bag 16 will be described with reference to (a) to (c) of FIG. 4.

The unsealing operation is performed in the order of a state shown in (a) of FIG. 4 and a state shown in (b) of FIG. 4. That is, the urging member 21 is rotated in the arrow C direction during the first use of the developing unit 38 to pull the sealing member 19 in a direction of an arrow D, so that the sealing member 19 is gradually peeled and thus the openings 35*a* are gradually exposed. Part (c) of FIG. 4 shows a state in which the unsealing (operation) is ended, and in this state, the openings 35*a* are completely exposed and thus the toner is capable of being discharged from the inside of the developer bag 16 in a direction of an arrow I.

Incidentally, at a side portion of the openings 35*a*, the developer bag 16 is locked to the frame 18 and therefore in the case where the sealing member 19 is wound up by the urging member 21, the developer bag 16 can be effectively unsealed without being moved together with the sealing member 19 in a winding-up direction.

(Developer Discharging Operation of Urging Member)

Next, a developer discharging operation from the developer bag 16 will be described with reference to FIGS. 5 and 6. FIG. 6 is a sectional view of the developing unit 38 when the urging member 21 is separated (spaced) from the developer bag 16.

As shown in FIG. 5, the urging sheet 21*b* has elasticity and therefore urges a portion of the developer bag 16 in the neighborhood of the openings 35*a* in an arrow J direction. At this time, the urging sheet 21*b* is deformed by the weight of the developer inside the developer bag 16 and urges the developer bag 16 by an elastic force for returning the urging sheet 21*b* to an original shape. By this urging, the developer bag 16 is deformed in the arrow J direction, so that also a force for moving the developer bag 16 in an upward direction of a direction G of gravitation acts on the developer bag 16.

At this time, the developer bag 16 is urged by the urging sheet 21*b* to be pressed against the frame 18, so that a whole of the developer bag 16 is deformed. Further, the developer bag 16 is urged by the urging sheet 21*b*, thus being reduced in inside volume. In this way, by the reduction in volume and the change in whole shape of the developer bag 16, the developer inside the developer bag 16 is stirred, so that the developer is easily discharged from the openings 35*a*.

Further, the developer bag 16 is closed at a portion other than the openings 35*a* and there is no escape route of the developer except for the openings 35*a*, and therefore the developer is discharged from the openings 35*a*. By such a discharging action, the developer is easily discharged in the arrow I direction.

Further, the urging member 21 provided inside the frames 17 and 18 urges the developer bag 16 to be pressed against the frame 18, so that a discharging property of the developer can be improved.

Further, as shown in FIG. 6, the urging member 21 is further rotated, so that the urging sheet 21*b* is separated from the developer bag 16. At this time, the developer bag 16 has flexibility and therefore is likely to be returned, by the weight of the developer, to a state before the developer bag 16 is urged (arrow K direction). Then, the urging sheet 21*b* is rotated, so that the urging sheet 21*b* urges the developer bag 16 toward the frame 18 as shown in FIG. 5 to deform the developer bag 16. This operation is repeated. By this repetition, also the developer located at a portion other than the openings 35*a* is moved, with the result that the developer is discharged from the openings 35*a*.

As described above, by the rotation of the urging member 21, the urging member 21 repeats contraction of the developer by periodical urging and shape restoration by the weight of the developer inside the developer bag 16 and by the flexibility of the developer bag 16. In this way, the developer bag 16 is vibrated, but also by this vibration, the developer inside the developer bag 16 is discharged from the openings 35*a*.

(Operation of Projected Portion)

Next, an operation (motion) of the projected portion 16*c* when the developer bag 16 is urged by the urging member 21 will be described.

As described above, the locked portion 16*d* of the developer bag 16 and the locking portion 18*a* of the container provide the gaps (spacings) with respect to the radial direction (G) and the height direction (H), and therefore the developer bag 16 is movable (FIG. 7). For this reason, by the urging operation by the urging sheet 21*b*, as described above, the developer bag 16 is deformed and at the same time, the position of the whole developer bag 16 is also moved. As shown in FIGS. 5 and 6, with the movement of the developer bag 16, also the projected portion 16*c* is moved in the G direction or the H direction. Then, with the rotation of the urging member 21, this movement is repeated, so that the projected portion 16*c* is vibrated.

By this movement and vibration of the projected portion 16*c*, as shown in FIG. 8, it is possible to stir the toner in the region X in the neighborhood of the developer supplying roller 23, and therefore it is possible to suppress stagnation of the toner in the neighborhood of the developer supplying roller 23.

Further, the projected portion 16*c* is provided below the openings 35*a* with respect to the direction of gravitation, and therefore the projected portion 16*c* can stir the toner discharged from the developing roller 16 with reliability. As a result, it is possible to stir a toner portion such that the toner portion prevents the discharge of the toner from the inside of the developer bag 16, so that the discharging property of the developer from the developer bag 16 can be improved.

Further, it is possible to stir the toner in the neighborhood of the developer supplying roller 23 by using a part of the developer bag 16, and therefore compared with the case where another stirring member is provided, it is possible to stir the toner in the neighborhood of the developer supplying roller 23 without increasing the number of parts.

Further, the projected portion 16*c* itself has a thin sheet-like shape, and therefore the projected portion 16*c* is capable of being disposed even in the case where the region X between the developer supplying roller 23 and the frame 18 is narrow.

(Other Shapes of Projected Portion)

Part (a) of FIG. 11 is a sectional view showing a hole shape of the locked portion 16*d* of the developer bag 16 and a shape of the elongated cylindrical columnar portion 18*e* of the locking portion 18*a* of the frame 18. Each of (b) to (g) of FIG. 11 is a sectional view showing a hole shape of the locked portion 16*d* of the developer bag 16 and another shape of the cylindrical columnar portion 18*e* of the locking portion 18*a* of the frame 18.

As shown in these figures, the shapes of the locked portion 16*d* of the developer bag 16 and the cylindrical columnar portion 18*e* of the frame 18 are not limited to the above-described circular shapes but may also be a rectangular shape, a polygonal shape, an elliptical shape, an elongated hole shape, and the like. In these cases, the developer bag 16 can be moved.

<Embodiment 2>

FIG. 12 is a sectional view showing a structure of a process cartridge A in this embodiment. Portions identical or similar to those in Embodiment 1 are represented by the same reference numerals or symbols and will be omitted from redundant description. A difference of this embodiment from Embodiment 1 is that the developer supplying roller 23 provided in Embodiment 1 is not provided in this embodiment. That is, the developer discharged from the openings 35*a* of the developer bag 16 is directly supplied to the developing roller 13.

(Arrangement of Projected Portion)

In this embodiment, in a cross section in an attitude of the projected portion 16*c* during image formation, an end portion of the projected portion 16*c* is located between an upper end and a lower end of the developing roller 13 with respect to the vertical direction. Further, with respect to the horizontal direction, the end portion of the projected portion 16*c* is disposed so as to be located in a region (hatched portion X in FIG. 12) between the developing roller 13 and the frame 18.

With movement of the developer bag 16 by the urging by the urging sheet 21*b*, also the projected portion 16*c* is moved, so that the toner in the neighborhood of the developing roller 13 can be stirred, and therefore it is possible to suppress the toner stagnation.

Further, by using a part of the developer bag 16, it is possible to stir the toner in the neighborhood of the developing roller 13. For this reason, compared with the case where another stirring member is provided, it is possible to stir the toner in the neighborhood of the developing roller 13 without increasing the number of parts.

Further, the projected portion 16*c* itself has a thin sheet-like shape, and therefore even in the case where the region X between the developing roller 13 and the frame 18 is narrow, the projected portion 16*c* is capable of being disposed.

According to the present invention, when the flexible container is urged by the urging member and thus is deformed, the projected portion of the flexible container is moved so as to stir the developer discharged from the openings. For this reason, stirring of the developer after the developer is discharged from the flexible container can be performed satisfactorily.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 193700/2012 filed Sep. 4, 2012, which is hereby incorporated by reference.

What is claimed is:

1. A developing unit comprising:

a frame;

a flexible container, provided inside said frame, for accommodating developer, wherein said flexible container includes an opening for permitting discharge of the developer;

an urging member, provided inside said frame, for urging said flexible container to deform said flexible container; and a developer carrying member for carrying the developer discharged from the opening of said flexible container, wherein said flexible container includes a projected portion projecting toward an outside of said flexible container, and wherein said projected portion is moved depending on deformation of said flexible container, by urging of said flexible container, to stir the developer discharged through the opening.

2. A developing unit according to claim 1, wherein at least a part of said projected portion is provided so as to be located between an upper end and a lower end of said developer carrying member with respect to a vertical direction during the image formation and so as to be located between said developer carrying member and said frame with respect to a horizontal direction.

3. A developing unit according to claim 1, further comprising a developer supplying roller for supplying the developer, discharged from said flexible container, to said developer carrying member, and wherein at least a part of said projected portion is provided so as to be located between an upper end and a lower end of said developer supplying roller with respect to a vertical direction during the image formation and so as to be located between said developer supplying roller and said frame with respect to a horizontal direction.

4. A developing unit according to claim 1, wherein said frame includes a locking portion for locking said flexible container to said frame, wherein said flexible container includes a locked portion locked to said locking portion, and wherein said locking portion and said locked portion are engaged with each other with a spacing therebetween.

5. A developing unit according to claim 1, wherein said urging member includes a rotatable member provided rotatably inside said frame and includes an urging sheet, provided on said rotatable member, for urging said flexible container, and wherein, when said rotatable member is rotationally driven, said urging sheet periodically urges said flexible container.

6. A developing unit according to claim 5, further comprising a sealing member for preventing the developer from being discharged before said developing unit is first used, wherein said sealing member seals the opening of said flexible container at one end portion and is fixed to said urging member at another end portion, and wherein, when said urging member is rotated at the time when said developing unit is first used, said urging member is peeled from the opening at said one end portion to permit discharge of the developer from the opening.

7. A developing unit according to claim 1, wherein said flexible container includes a first flexible member having a three-dimensional shape for accommodating the developer and includes a planar second flexible member provided for sealing said first flexible member, and wherein said projected portion includes an edge portion of at least one of said first flexible member and said second flexible member.

8. A developing unit according to claim 1, wherein said projected portion of said flexible container is constituted by bonding a plurality of members, constituting said flexible container, to each other or by folding back a member constituting said flexible container.

9. A developing unit according to claim 1, wherein said projected portion is branched into a plurality of portions thereof.

10. A process cartridge detachably mountable to a main assembly of an image forming apparatus, said process cartridge comprising:

a developing unit according to claim 1.

11. An image forming apparatus for forming an image on an image forming material, said image forming apparatus comprising:

a process cartridge according to claim 10; and transfer means for transferring the image formed by development by said process cartridge.

12. A developing unit according to claim 1, wherein said flexible container includes a hole that is different from the opening and said frame includes a columnar portion engaging with the hole.

13. A developing unit according to claim 12, wherein a diameter of the hole is larger than that of said columnar portion.

14. A developing unit according to claim 1, wherein said flexible container includes a plurality of openings for permitting discharge of the developer.

15. A developing unit according to claim 1, wherein said opening is disposed so as to open downward direction of said flexible container.

16. A developing unit comprising:

a frame;

a flexible container, provided inside said frame, for accommodating developer, wherein said flexible container includes a plurality of openings for permitting discharge of the developer;

an urging member, provided inside said frame, for urging said flexible container to deform said flexible container; and a developer carrying roller for carrying the developer discharged from the openings of said flexible container, wherein said flexible container includes a projected portion projecting toward an outside of said flexible container and toward said developer carrying roller, and wherein said projected portion is moved depending on deformation of said flexible container, by urging of said flexible container.

17. A developing unit according to claim 16, wherein at least a part of said projected portion is provided so as to be located between an upper end and a lower end of said developer carrying roller with respect to a vertical direction during the image formation and so as to be located between said developer carrying roller and said frame with respect to a horizontal direction.

18. A developing unit according to claim 16, further comprising a developer supplying roller for supplying the developer, discharged from said flexible container, to said developer carrying roller, and wherein at least a part of said projected portion is provided so as to be located between an upper end and a lower end of said developer supplying roller with respect to a vertical direction during the image formation and so as to be located between said developer supplying roller and said frame with respect to a horizontal direction.

19. A developing unit according to claim 16, wherein said frame includes a locking portion for locking said flexible container to said frame, wherein said flexible container includes a locked portion locked to said locking portion, and wherein said locking portion and said locked portion are engaged with each other with a spacing therebetween.

20. A developing unit according to claim 16, wherein said urging member includes a rotatable member provided rotatably inside said frame and includes an urging sheet, provided on said rotatable member, for urging said flexible container, and wherein, when said rotatable member is rotationally driven, said urging sheet periodically urges said flexible container.

21. A developing unit according to claim 20, further comprising a sealing member for preventing the developer from being discharged before said developing unit is first used, wherein said sealing member seals the openings of said flexible container at one end portion and is fixed to said urging member at another end portion, and wherein, when said urging member is rotated at the time when said developing unit is first used, said urging member is peeled from the openings at said one end portion to permit discharge of the developer from the openings.

22. A developing unit according to claim 16, wherein said flexible container includes a first flexible member having a three-dimensional shape for accommodating the developer and includes a planar second flexible member provided for sealing said first flexible member, and wherein said projected portion includes an edge portion of at least one of said first flexible member and said second flexible member.

23. A developing unit according to claim 16, wherein said projected portion of said flexible container is constituted by bonding a plurality of members, constituting said flexible container, to each other or by folding back a member constituting said flexible container.

24. A developing unit according to claim 16, wherein said projected portion is branched into a plurality of portions thereof.

25. A process cartridge detachably mountable to a main assembly of an image forming apparatus, said process cartridge comprising:

a developing unit according to claim 16.

26. An image forming apparatus for forming an image on an image forming material, said image forming apparatus comprising:

a process cartridge according to claim 25; and transfer means for transferring the image formed by development by said process cartridge.

27. A developing unit according to claim 16, wherein said flexible container includes a hole that is different from the openings and said frame includes a columnar portion engaging with the hole.

28. A developing unit according to claim 27, wherein a diameter of the hole is larger than that of said columnar portion.

29. A developing unit according to claim 16, wherein the openings are disposed so as to open downward direction of said flexible container.

* * * * *